United States Patent [19]

Duffy et al.

[11] Patent Number: 4,815,414

[45] Date of Patent: Mar. 28, 1989

[54] POWDER SPRAY APPARATUS

[75] Inventors: Richard Duffy, Mt. Clemens; Eugene Sessa, Utica, both of Mich.

[73] Assignee: Nylok Fastener Corporation, Rochester, Mich.

[21] Appl. No.: 40,377

[22] Filed: Apr. 20, 1987

[51] Int. Cl.[4] ..... B05B 7/14

[52] U.S. Cl. ..... 118/308; 239/654; 239/655; 222/637; 406/123; 406/139

[58] Field of Search ..... 118/308; 239/654, 655; 222/637; 406/123, 137

[56] References Cited

U.S. PATENT DOCUMENTS

| | | | |
|---|---|---|---|
| 2,198,587 | 4/1940 | Skinner | 222/637 X |
| 3,463,120 | 8/1969 | Wallis | 118/308 X |
| 4,008,854 | 2/1977 | van der Lely | 239/655 |
| 4,131,072 | 12/1978 | Lingl et al. | 406/123 X |
| 4,319,717 | 3/1982 | Hofmann | 239/654 |
| 4,440,806 | 4/1984 | Muri | 118/308 X |
| 4,640,219 | 2/1987 | Anderson et al. | 118/308 X |

FOREIGN PATENT DOCUMENTS

| | | | |
|---|---|---|---|
| 57-137223 | 8/1982 | Japan | 406/123 |

*Primary Examiner*—Shrive Beck

*Attorney, Agent, or Firm*—Niro, Scavone, Haller, Niro & Rockey, Ltd.

[57] ABSTRACT

A method and apparatus for spraying powder material from a plurality of nozzles. A powder material feed control section and a manifold section provide a uniform flow rate and uniform density pattern for a powder material feed stream sprayed from a plurality of nozzles.

28 Claims, 2 Drawing Sheets

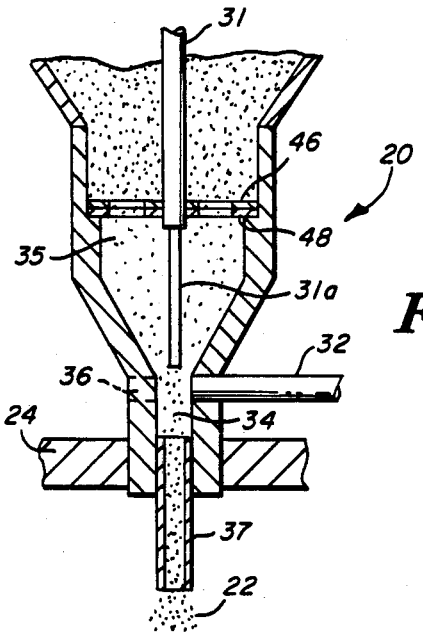
FIG. 3
FIG. 4
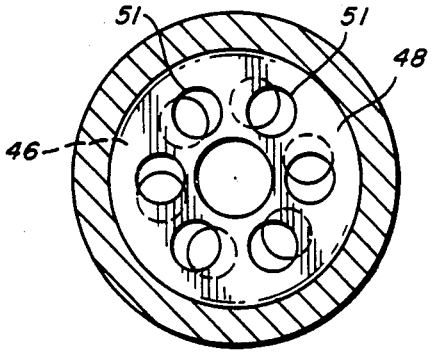
FIG. 5
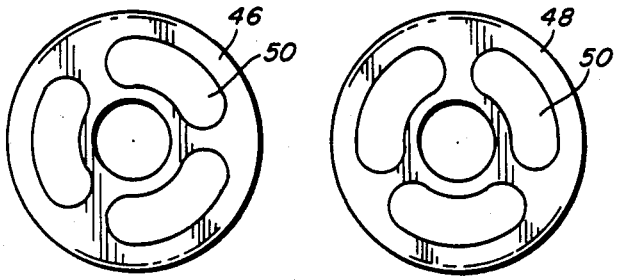

POWDER SPRAY APPARATUS

The present invention is generally related to an apparatus and method for dispensing a powder material through one or more spray nozzles. More particularly, the invention is related to a powder spray apparatus having a sensitive control section for regulating the powder material feed rate to a manifold which enables the uniform distribution of the powder to one or a plurality of spray nozzles.

Previous apparati have provided for distributing powder material to a spray nozzle. Apparatus has also been recently developed for dispersing powder material through a plurality of spray nozzles. However, these various apparati are complicated, inefficient and require expensive structural components in order to control the flow of powder material. Such apparati also experience difficulties in controlling the regularity of powder flow rate and uniformity of the density of the powdered material in the spray pattern from a nozzle.

BRIEF SUMMARY OF THE INVENTION

A principal object of the invention is to provide an imported apparatus and method for dispersing a powder to one or more spray nozzles.

A more detailed objective of the invention is to provide a novel apparatus and method for uniformly dispersing a powder to one or more spray nozzles, while exercising sensitive control over powder feed rate and the flow pattern of the powder sprayed from each of the nozzles.

An additional object of the invention is to provide an improved apparatus for uniformly dispersing powder material through one or more spray nozzles utilizing a simple manifold structure which allows for powder material output through lines connected to associated spray nozzles.

Further objects and advantages of the present invention, together with the organization and manner of operation thereof, will become apparent from the following description of the invention when taken in conjunction with the accompanying drawings wherein like reference numerals designate like components throughout the several views.

BRIEF DESCRIPTION OF THE DRAWINGS

FIG. 3 is a detailed cross sectional view of a gas pressure control portion of a powder material feed section;

FIG. 4 is a cross sectional view taken along 4—4 in FIG. 1; and

FIG. 5 illustrates two disks for placement adjacent one another as part of the feed control section of FIG. 4.

DETAILED DESCRIPTION OF PREFERRED EMBODIMENT

Figure 1:
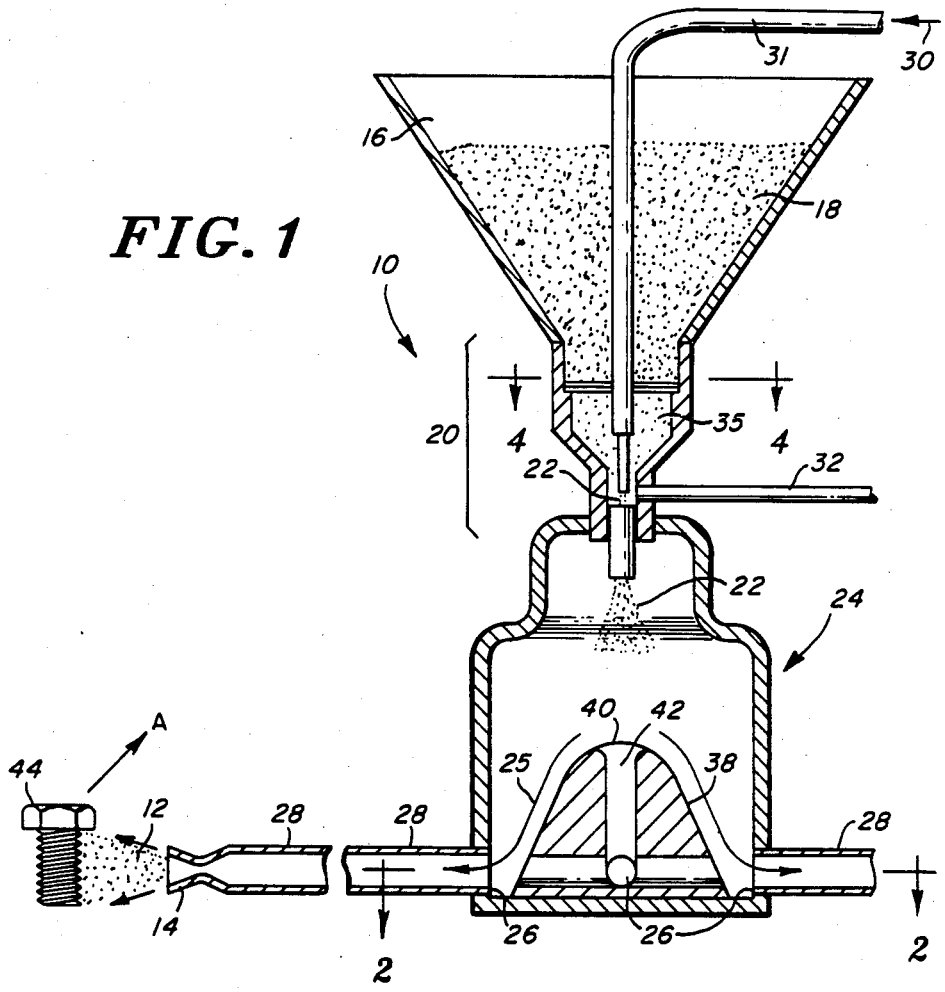
FIG. 1 is an elevation view showing a cross section of one embodiment of the invention.
Figure 2:
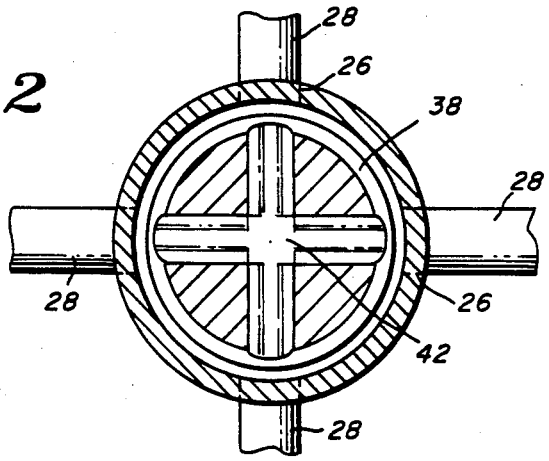
FIG. 2 is a cross sectional view taken along 2—2 in FIG. 1.

Referring now to the drawings and in particular to FIG. 1, a cross sectional view of an apparatus constructed in accordance with one embodiment of the present invention is indicated generally at 10. The apparatus 10 is utilized for dispersing a powder stream 12 through at least one and preferably a plurality of spray nozzles 14. The apparatus 10 includes means for providing a powder material, such as, for example, a reservoir 16 containing powder 18. The powder 18 is, for example, a fluorocarbon based material. An example of such a material is manufactured by DuPont Corp. and distributed under the mark Teflon-P. Examples of other thermoplastic material are nylon, acrylic or polyethylene based materials. The apparatus 10 further comprises feed means, including, for example, a powder food section 20, for controllably removing the powder 18 from the reservoir 16. The reservoir 16 can be vibrated to control the rate of removal of the powder 18, and the powder feed section 20 generates a powder material feed stream 22 (hereinafter, the feed stream 22). This feed stream 22 is input to manifold means, such as a manifold 24, for receiving and uniformly distributing the feed stream 22 through one or more output ports 26. Each of the output ports 26 are in communication by a conduit 28 with an associated one of the plurality of the spray nozzles 14. The feed stream 22 is propelled by an air stream 30 passing through a gas conduit 31 and through the manifold 34. The resulting output from the manifold 24 forms a feed output stream 25 and generates the powder stream 12 from each of the one or more output ports 26. The air stream 30 is created by a regulated high pressure gas source (not shown), and the gas source is typically air, or can be an inert gas, such as nitrogen or argon.

The powder feed section 20 also includes means for varying the feed inlet rate of the powder 18. In the embodiments of FIGS. 1 and 3 are illustrated various forms of this feed inlet varying means. Generally, the feed rate can be controlled by vibrating the reservoir 16 at desired frequencies and amplitudes, varying the size of the flow path experienced by the powder 18 and controlling the air pressure in the powder feed section 20.

In FIG. 3 the gas conduit 31a temporarily terminates within the reservoir output opening 35. An air stream 34 output from the gas conduit 31*a* causes a Venturi type reduction in pressure in the powder feed section region behind, or upstream of the end of the gas conduit 31*a*. Therefore, by varying the flow rate of the air stream 34 the flow rate of the feed stream 22 can be regulated. Furthermore, as shown in FIGS. 1 and 3 a gas pressure conduit 32 opens into a reservoir output opening 35. The user can control the flow rate of the feed stream 22 by changing the air pressure in the region of the reservoir output opening 35. This change of air pressure can be accomplished by varying gas pressure in the pressure conduit 32 or by having a variable size gas pressure opening 36 (in phantom in FIG. 3) into the region of the reservoir output opening 35. The size of the opening 36 can be accomplished in a number of conventional ways, such as an adjustable aperture lens (not shown).

Downstream of the end of the gas conduit 31*a*, a collection conduit 37 acts to collect the pressure regulated feed stream 22 and directs the feed stream 22 into the manifold 24 for dispersion in the form of the powder stream 12 from one or more of the outlet ports 26.

The manifold 24 shown in FIG. 1 is a chamber which in the preferred embodiment has plural outputs and includes a powder distribution surface 38 having an upper surface, a lower surface, a height and a slope for dividing the feed stream 22 into uniform portions for input to each of the output ports 26. The feed stream 22 is introduced into the input, or upper, portion of the manifold 24. The feed stream 22 is intercepted by the upper surface of the powder distribution surface 38 and is substantially uniformly divided by the powder distribution surface 38 and is directed or channeled to the output portion of the manifold 24, which includes the bottom or lower surface of the distribution surface 38 near the output ports 26. Preferably, the plurality of output ports 26 are uniformly distributed along substantially the same horizontal line of the output end portion of the manifold 24 (see FIG. 1). Furthermore, the output ports 26 are substantially uniformly distributed about the output portion of the manifold 24, and the diameter of each of the output ports 26 is less than the inside diameter of the manifold 24. The distribution surface 38 is preferably a conical surface having an upper surface, a rounded tip or end portion 40 and includes lower surface or trough portions 42 for channeling the feed stream 22 into the output ports 26. In other forms of the invention there is no distribution surface 38 used within the manifold 24.

In the embodiment of FIG. 1 the feed stream 22 carried by the air stream 30 becomes the feed output stream 25 which is output as the powder stream 12 from each of the spray nozzles 14. The powder 18 is then applied by the user in the desired manner for the intended purpose. In FIG. 1 a fastener 44 is depicted as being transported through the powder stream 12 along the direction of the arrow A shown adjacent to the fastener 44. The fastener 44 is heated to enable the powder 18, which contacts the fastener 44, to soften and adhere to the threaded areas of the fastener 44. The embodiment using a plurality of spray nozzles 14 can be used to coat separate processions of the fasteners 44 or can act sequentially to apply a plural number of layers of the powder 18 to one or more processions of the fasteners 44. As a consequence of the sensitive control of flow rate and uniformity of the pattern of the powder stream 12, the apparatus 10 has particular advantages in applying a uniform coating of the powder 18 over the entire threaded area of the fastener 44.

In another aspect of the apparatus 10, a continuous supply of the powder 18 is provided to the powder feed section 20. Additional control of the feed inlet rate can be accomplished by means for providing an adjusting size opening for the reservoir output opening 35. In FIGS. 4 and 5 such means is, for example, two adjacent disks 46 and 48 having a plurality of holes 50. These disks 46 and 48 are rotatably adjustable relative to one another to vary the size of the resulting opening shown in full lines 51 in FIG. 4. In another embodiment the gas conduit 31 or 31a in FIGS. 1 and 3, respectively, can be lowered or raised within the reservoir output opening 35, enabling a controllable change in the gap between the conduit and inside walls 52 and consequent change of the feed inlet rate.

The apparatus and method of the present invention enables the dispersal of powder material through one or a plurality of spray nozzles and also allows generation of a highly uniform spray pattern of the powder material from each of the spray nozzles. The apparatus includes a sensitive gas pressure control section for regulating the powder material feed rate to a manifold which distributes the powder material uniformly to one or more of the spray nozzles. This gas pressure control section also enables further control of the density of powder material in the stream of powder sprayed by each nozzle. This apparatus and method has particular advantages for spraying thermoplastic type powder materials onto threaded fasteners.

While preferred embodiments of the present invention have been illustrated and described, it will be understood that changes and modifications may be made therein without departing from the invention in its broader aspects. Various features of the invention are defined in the following claims.

What is claimed is:

1. An apparatus for generating a powder stream through each of a plurality of nozzles, comprising:

a source for powder material;

means for controllably removing said powder material from said source and for generating a stream of said powder material;

means for regulating the characteristics of said stream; and manifold means for receiving said stream from said source, said manifold means including a plurality of output ports with each of said output ports in communication with an associated one of said plurality of nozzles for spraying said powder stream, said manifold means including a powder distribution surface having an upper surface, a lower surface, a height and a slope and disposed within said manifold means such that said powder stream from said source is intercepted by said upper surface of said powder distribution surface, said upper and lower surfaces of said powder distribution surface uniformly distributing and channeling substantially all of said powder stream to each of said plurality of output ports and said plurality of nozzles.

2. The apparatus as defined in claim 1 wherein said manifold means comprises a chamber having an input portion and an output portion, said output ports substantially uniformly distributed about said output portion and the diameter of said output ports less than the inside diameter of said chamber.

3. The apparatus as defined in claim 2 wherein the centers of said output ports are uniformly distributed along substantially the same horizontal line of said output portion.

4. A powder spray apparatus for generating a powder stream from a nozzle, comprising:

a reservoir for holding powder material, said reservoir having a reservoir output opening for dispensing a feed stream of said powder material;

a powder material control section for regulating the flow of said powder material feed stream through said reservoir output opening, said powder material control section having a gas pressure opening in communication with said reservoir output opening; and manifold means for receiving said powder material feed stream from said reservoir output opening, said manifold means including an output port in communication with said nozzle and a feed stream distribution surface having an upper surface, a lower surface, a height and a slope positioned within said manifold means such that said powder material feed stream is directed toward said upper surface of said feed stream distribution surface, said upper and lower surfaces providing uniform distribution and delivery of substantially all of said powder material feed stream received by said manifold means to said output port and said nozzle.

5. An apparatus for generating a powder stream through a plurality of spray nozzles, comprising:

means for providing a powder material;

feed means for controllably removing said powder material from said powder providing means and for generating a feed stream of said powder material; and manifold means for receiving and uniformly distributing said feed stream, said manifold means including a plurality of output ports in communication with said spray nozzles and a feed stream distribution surface having an upper surface, a lower surface, a height and a slope positioned within said manifold means such that said stream is intercepted by said upper surface, said upper and lower surfaces dividing and directing substantially all of said feed stream received by said manifold means and intercepted by said feed stream distribution surface into uniform portions for input to each of said output ports and for output through said spray nozzles.

6. The apparatus as defined in claim 5 wherein said powder distribution surface comprises a smooth conical surface.

7. The apparatus as defined in claim 6 wherein said conical surface has a rounded end portion.

8. The apparatus as defined in claim 6 wherein said conical surface includes troughs leading to each of said output ports.

9. The apparatus as defined in claim 6 wherein the areal opening of each of said output ports is larger than the areal opening of each said associated nozzle.

10. An apparatus for dispensing powder and generating a powder stream through at least one nozzle, comprising:

a source for said powder;

a feed device for removing said powder from said powder source and providing a feed stream of said powder, said feed device having means for varying the inlet rate of said feed stream;

means for further controlling the characteristics of said feed stream comprising means for supplying at least one of a positive and a negative pressure from an independent fluid stream;

a manifold for receiving said powder from said feed device;

at least one passageway coupled at its input end to said manifold;

an associated powder spray nozzle coupled to the output end of each said passageway; and gas stream means for generating a controllable gas flow into said manifold and for transporting said feed stream uniformly to the output end of said manifold, said manifold dispersing said feed stream through each said passageway for output of said powder stream through each said associated powder spray nozzle.

11. The apparatus of claim 10 wherein said gas stream means is operatively discontinuous above the inlet to said manifold.

12. The apparatus of claim 11 wherein said gas stream means further comprises a gas line upstream of the discontinuity, the tip of said gas line having a smaller cross sectional area at said discontinuity than at the upstream portion of said gas line.

13. An apparatus for generating a powder stream through a plurality of spray nozzles, comprising:

means for providing a powder material;

feed means for controllably removing said powder material from said powder providing means and for generating a feed stream of said powder material;

fluid pressure means in communication with said feed means for further regulating the characteristics of said feed stream; and manifold means for receiving and uniformly distributing said feed stream, said manifold means including a plurality of output ports and a feed stream distribution surface having an upper surface, a lower surface, a height and a slope and positioned within said manifold means such that said feed stream is intercepted by said upper surface, said upper and lower surfaces dividing said feed stream into substantially uniform portions and directing substantially all of said feed stream received by said manifold means and intercepted by said upper surface for input to each of said output ports and for output through each of said spray nozzles.

14. The apparatus of claim 13 wherein said means for providing a powder material comprises a reservoir for holding said powder material and control means for regulating the flow into said manifold means of said powder material stream.

15. The apparatus as defined in claim 14 wherein said reservoir includes a reservoir output opening and said control means comprises a gas pressure conduit being disposed within said reservoir output opening, said gas pressure conduit positionally adjustable within said reservoir output opening.

16. The apparatus as defined in claim 14 wherein said feed stream distribution surface comprises a smooth conical surface.

17. The apparatus as defined in claim 16 wherein said conical surface has a rounded end portion.

18. A powder spray apparatus for generating a powder stream from a nozzle, comprising:

a reservoir for holding powder material, said reservoir having a reservoir output opening for dispensing a feed stream of said powder material;

a powder material control section for regulating the flow of said powder material feed stream through said reservoir output opening, said powder material control section having a gas pressure means in communication with said reservoir output opening for providing a gas stream and fluid pressure means in communication with said reservoir output opening for further regulating the characteristics of said feed stream; and manifold means for receiving and uniformly distributing said powder material feed stream received from said reservoir, said manifold means including an output port in communication with said nozzle.

19. The apparatus of claim 18 wherein said fluid pressure means is controlled independently of said gas pressure means.

20. The apparatus of claim 19 wherein said fluid pressure means comprises means for supplying one of a positive pressure and a negative pressure.

21. The apparatus of claim 20 wherein said powder material control section further comprises an aperture for varying the pressure in said powder material control section.

22. The apparatus of claim 18 wherein said gas pressure means terminates within said powder material control section.

23. The powder spray apparatus as defined in claim 18 wherein said reservoir output opening of said powder material control section includes means for providing an adjustable opening size.

24. The powder spray apparatus as defined in claim 23 wherein said means for providing an adjustable opening size comprises two adjacent disks rotatably adjustable relative to one another with each of said disks having a plurality of holes.

25. The powder spray apparatus as defined in claim 18 wherein said reservoir provides a continuous flow of said feed stream.

26. The powder spray apparatus as defined claim 18 wherein said manifold means includes a plurality of said output ports substantially uniformly distributed near the output end of said manifold means with each of said output ports in communication with an associated nozzle.

27. An apparatus for dispensing powder and generating a powder stream through at least one nozzle, comprising:

a source for said powder;

a feed device for removing said powder from said powder source and providing a feed stream of said powder, said feed device having means for varying the inlet rate of said feed stream;

means for further controlling the characteristics of said feed stream comprising an aperture for varying the fluid pressure of an independent fluid stream;

a manifold for receiving said powder from said feed device;

at least one passageway coupled at its input end to said manifold;

an associated powder spray nozzle coupled to the output end of each of said passageway; and gas stream means for generating a controllable gas flow into said manifold and for transporting said feed stream uniformly to the output end of said manifold, said manifold dispersing said feed stream through each said passageway for output of said powder stream through each said associated powder spray nozzle.

28. The apparatus of claim 27 wherein said aperture is adapted to be changeable in the opening size.

* * * * *

UNITED STATES PATENT AND TRADEMARK OFFICE

CERTIFICATE OF CORRECTION

PATENT NO. : 4,815,414

DATED : March 28, 1989

INVENTOR(S) : Richard Duggy & Eugene Sessa

It is certified that error appears in the above-identified patent and that said Letters Patent is hereby corrected as shown below:

Claim 5, column 5, line 11, "feed" should be inserted before the word "stream".

Signed and Sealed this

Third Day of April, 1990

*Attest:*

HARRY F. MANBECK, JR.

*Attesting Officer*

*Commissioner of Patents and Trademarks*